US010252394B2

(12) United States Patent
Steinwender

(10) Patent No.: US 10,252,394 B2
(45) Date of Patent: Apr. 9, 2019

(54) PRESSING DEVICE HAVING A TOOTHED BELT

(71) Applicant: Thielenhaus Technologies GmbH, Wuppertal (DE)

(72) Inventor: Holger Steinwender, Wuppertal (DE)

(73) Assignee: THIELENHAUS TECHNOLOGIES GMBH, Wuppertal (DE)

( * ) Notice: Subject to any disclaimer, the term of this patent is extended or adjusted under 35 U.S.C. 154(b) by 110 days.

(21) Appl. No.: 15/312,625

(22) PCT Filed: May 20, 2015

(86) PCT No.: PCT/EP2015/061148
§ 371 (c)(1),
(2) Date: Nov. 18, 2016

(87) PCT Pub. No.: WO2015/177230
PCT Pub. Date: Nov. 26, 2015

(65) Prior Publication Data

US 2017/0087685 A1 Mar. 30, 2017

(30) Foreign Application Priority Data

May 22, 2014 (DE) ..... 20 2014 102 403 U

(51) Int. Cl.
*B24B 21/02* (2006.01)
*B24B 21/16* (2006.01)
(Continued)

(52) U.S. Cl.
CPC ..... *B24B 21/02* (2013.01); *B24B 21/16* (2013.01); *B24B 21/20* (2013.01); *B24B 35/00* (2013.01)

(58) Field of Classification Search
CPC ..... B24B 21/02; B24B 21/16; B24B 21/20; B24B 19/12; B24B 35/00; B24D 9/085; B24D 15/04
(Continued)

(56) References Cited

U.S. PATENT DOCUMENTS 2,376,531 A * 5/1945 Egger ..... B24B 5/42 451/181
5,148,636 A * 9/1992 Judge ..... B24B 21/02 451/25
(Continued)

FOREIGN PATENT DOCUMENTS

DE 102007051047 A1 4/2009
DE 202013005504 U1 8/2013
DE 202014000094 U1 2/2014
WO WO 2015104372 A1 * 7/2015 ..... B24B 21/20

OTHER PUBLICATIONS

Klaus, "International Search Report issued in corresponding international application No. PCT/EP2015/061148", dated Aug. 11, 2015, 4 pages.

*Primary Examiner* — Eileen Morgan
(74) *Attorney, Agent, or Firm* — Johnson, Marcou & Isaacs, LLC; Jennifer S. Stachniak

(57) ABSTRACT

A pressing device (1) for pressing finishing tape against circumferential surfaces (2) of substantially cylindrical work piece sections (3) in a finishing process includes at least one elastically bendable pressing element (5) that is substantially inelastic in the longitudinal direction. A support element (6) has two bearings (7), which are arranged at a distance from each other. The pressing element (5) is fastened to the two bearings, and the two bearings are arranged in such a manner that finishing tape is pressed against a circumferential surface (2) by the pressing element (5) across a contact angle (4) using a pressing force. The pressing device (1) is adjustable in order to process work piece sections (3) of
(Continued)

different diameters. The pressing element may be a toothed belt (5) having tooth-like ribs (8), and the toothed belt (5) is interlockingly mounted in the support element (6) using the tooth-like ribs (8).

11 Claims, 3 Drawing Sheets

(51) Int. Cl.
*B24B 21/20* (2006.01)
*B24B 35/00* (2006.01)

(58) Field of Classification Search
USPC ..... 451/302, 303, 310, 495, 513
See application file for complete search history.

(56) References Cited

U.S. PATENT DOCUMENTS 5,490,808 A * 2/1996 Jantschek ..... B24B 5/42 451/168
5,695,391 A * 12/1997 Steinwender ..... B24B 5/42 451/168
5,775,978 A * 7/1998 Brocksieper ..... B24B 19/11 451/302
6,080,051 A * 6/2000 Weber ..... B24B 5/42 451/303
6,095,909 A * 8/2000 Chenu ..... B24B 21/004 451/302
8,408,973 B2 * 4/2013 Grabsch ..... B24B 35/00 451/168

* cited by examiner

PRESSING DEVICE HAVING A TOOTHED BELT

CROSS REFERENCE TO RELATED APPLICATIONS

The instant application should be granted the priority dates of May 20, 2015, the filing date of the international patent application PCT/EP2015/061148, and May 22, 2014, the filing date of DE 20 2014 102 403.4.

BACKGROUND OF THE INVENTION

The present invention relates to a pressing device for pressing finishing tapes against circumferential surfaces of substantially cylindrical work piece sections in a finishing process, the pressing device comprising at least one elastically bendable pressing element, which is substantially inelastic in the longitudinal direction and is fastened to two bearings of a support element, which are arranged at a distance from each other, in such a manner that the finishing tape is pressed against a circumferential surface by the pressing element along a contact angle, using a pressing force, and that the pressing device can be adjusted in order to process work piece sections of different diameters.

A pressing device of this type having the features mentioned above is known for example from DE 20 2013 005 504 U1. In this pressing device, the pressing element in the form of a pressing strip is formed by a spring steel strip or a fibre-reinforced elastic material, which is fixed to a support element by screw-fastening.

SUMMARY OF THE INVENTION

The object of the present invention is to provide an alternative pressing element for a pressing device, it being possible for said pressing element to be fastened to the support element in a predefinable position.

This object is achieved with a pressing device having the features of the independent claim. Advantageous developments of the pressing device are specified in the dependent claims and in the description; features of the advantageous developments can be combined with each other in any desired technologically meaningful manner.

In particular, the object is achieved in that the pressing element is a toothed belt, which has tooth-like ribs and is interlockingly (or positive lockingly, German: formschlüssig) mounted in the support element using the tooth-like ribs.

Reference is made to the entirety of DE 20 2013 005 504 U1, which is mentioned in the introduction, for the function and design of the pressing device.

According to the present invention, the pressing element that presses the finishing tape against the cylindrical work piece section to be processed is a strip in the form of a toothed belt, ribs that are aligned transversely to the longitudinal direction of the toothed belt being arranged over the entire extent of the toothed belt. The tooth-like ribs also formed in the end regions of the toothed belt are used to fasten the toothed belt interlockingly to the support element in corresponding recesses. In particular, this has the advantage that the position of the toothed belt on the support element is predefined exactly by the recesses in the support element. In addition, the toothed belt is in particular fastened to the support element in the longitudinal direction of the toothed belt solely by the interlock (or positive lock), and therefore the toothed belt can be changed simply by displacement transverse to the longitudinal direction of the toothed belt.

In a preferred orientation of the tooth-like ribs of the toothed belt to the side of the toothed belt facing the cylindrical work piece section the advantage also emerges that the pressing element adjusts particularly well to the cylindrical work piece section in some sections in the region of the tooth-like ribs.

Alternatively, the tooth-like ribs of the toothed belt can be arranged on the side of the toothed belt that faces away from the work piece section, so that the toothed belt presses the finishing tape against the work piece section with the relatively flat side of the toothed belt.

In a preferred embodiment of the pressing device, the toothed belt comprises a fabric running in the longitudinal direction and/or steel strips running in the longitudinal direction, around which an elastic plastic is injection-moulded, which forms the tooth-like ribs. The combination of fabric and steel strips ensures that the toothed belt is inelastic in the longitudinal direction, the elastic plastic ensuring adaptation of the toothed belt to the work piece section to be processed.

In a further embodiment of the pressing device, a clamping device for fastening the toothed belt to the support element is formed in addition to the interlocking connection between the toothed belt and the support element. Such a clamping device can for example be formed by a screw fastening and a threaded hole formed in the support element, the screw fastening being guided through a hole in the toothed belt so that force is applied to the sections of the support element that surround the toothed belt in such a manner that the toothed belt is clamped in place.

According to a preferred embodiment of the pressing device, the toothed belt consists of polyurethane, at least on the surface thereof. In particular, the above-mentioned elastic plastic is polyurethane.

According to a further embodiment of the pressing device, the tooth-like ribs are introduced only in some recesses formed in the support element, in order to change the length of the section of the toothed belt between the bearings. In this manner, the free length of the toothed belt between the bearings can be set simply using only one toothed belt.

BRIEF DESCRIPTION OF THE DRAWINGS

The invention and the technical background are explained below using the figures; it should be noted that the figures show a preferred embodiment of the invention, but the invention is not limited thereto. In the figures.

DETAILED DESCRIPTION OF SPECIFIC EMBODIMENTS

Figure 1:
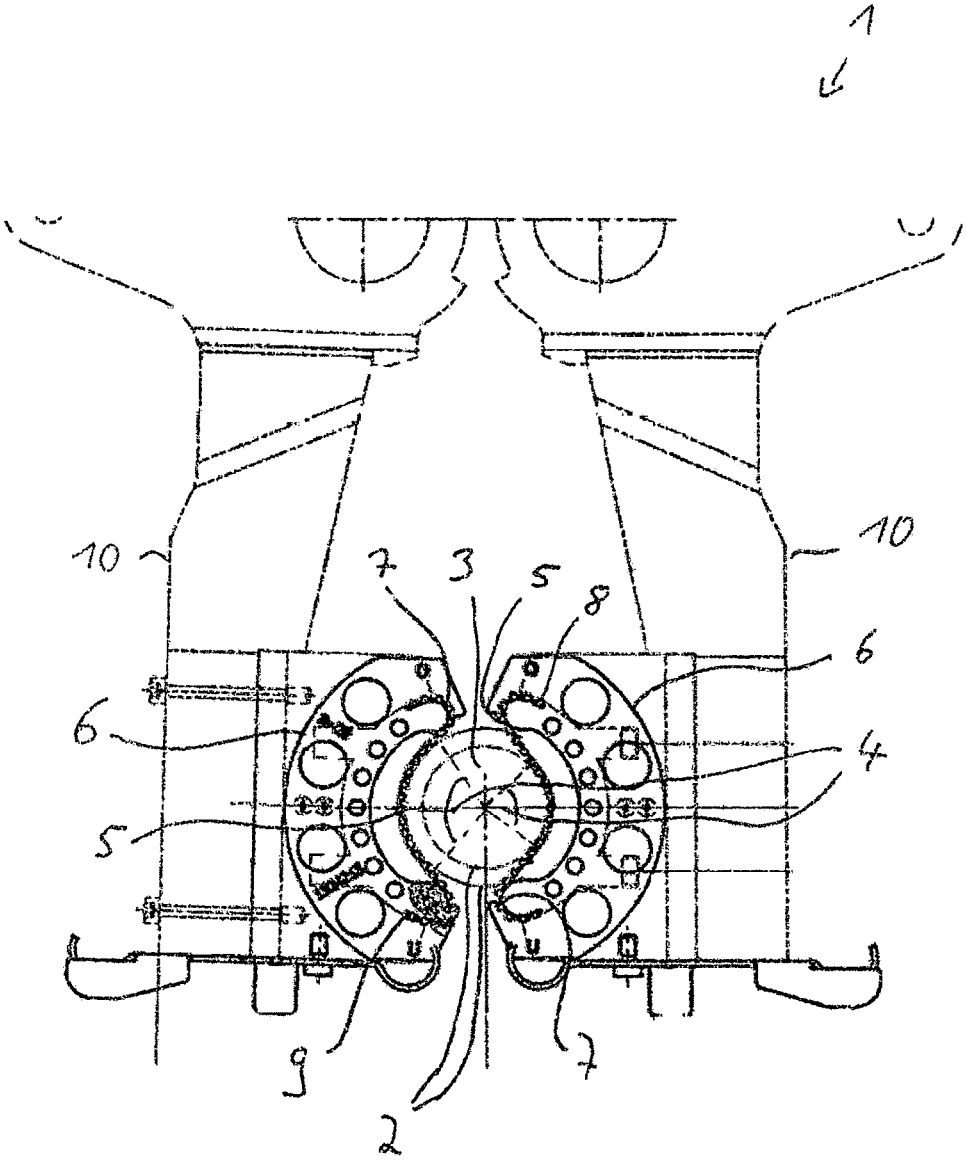
FIG. 1: schematically shows a pressing device.

FIG. 1 shows a device 1 for processing circumferential surfaces 2 of a work piece section 3. The device 1 comprises two pivotable arms 10, at the ends of which a support element 6 is fastened in each case. A toothed belt 5, which can press a finishing tape (not shown) against the circumferential surface 2 of a cylindrical work piece section 3, is fastened to each support element 6. The toothed belt 5, which has tooth-like ribs 8, the longitudinal direction of which is arranged transversely thereto, is fastened interlockingly in recesses 11, which are formed in the support element 6 such that they correspond to the tooth-like ribs 8. In addition, a clamping device 9 can be provided to fasten the toothed belt 5 to the support element 6.

With the pressing device shown, it is possible to process cylindrical work piece sections 3 with different diameters. For instance, FIG. 1 shows the processing of a work piece section 3 with a relatively large diameter on the left-hand side and the processing of a work piece section 3 with a relatively small diameter on the right-hand side. Consequently, the toothed belt 5 and therefore also the finishing tape (not shown) bear against the work piece sections 3 along different contact angles 4.

Figure 2:
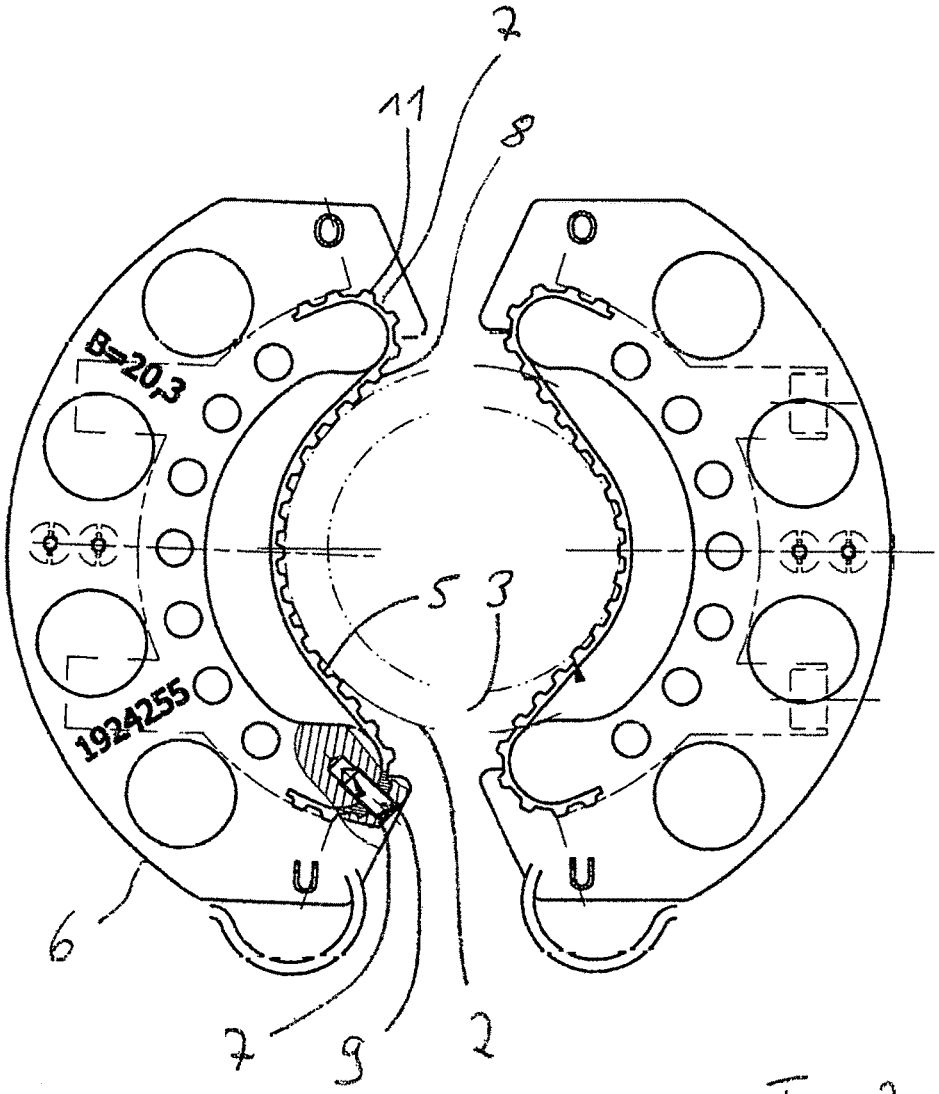
FIG. 2: schematically shows a first embodiment of the support elements of the pressing device.

FIG. 2 shows the support elements 6 with the toothed belts 5 each fastened therein. The toothed belt 5 is fastened to the support element 6 by means of an interlock between the tooth-like ribs 8 thereof and recesses 11 in the support element 6 and is additionally secured by means of a clamping device 9. The clamping device 9 comprises a threaded bore in the support element 6 and a screw fastening that passes through a hole in the toothed belt 5 and engages in the threaded bore. In the embodiment of FIG. 2, the tooth-like ribs 8 are arranged on the side of the toothed belt 5 that faces the work piece section 3.

Figure 3:
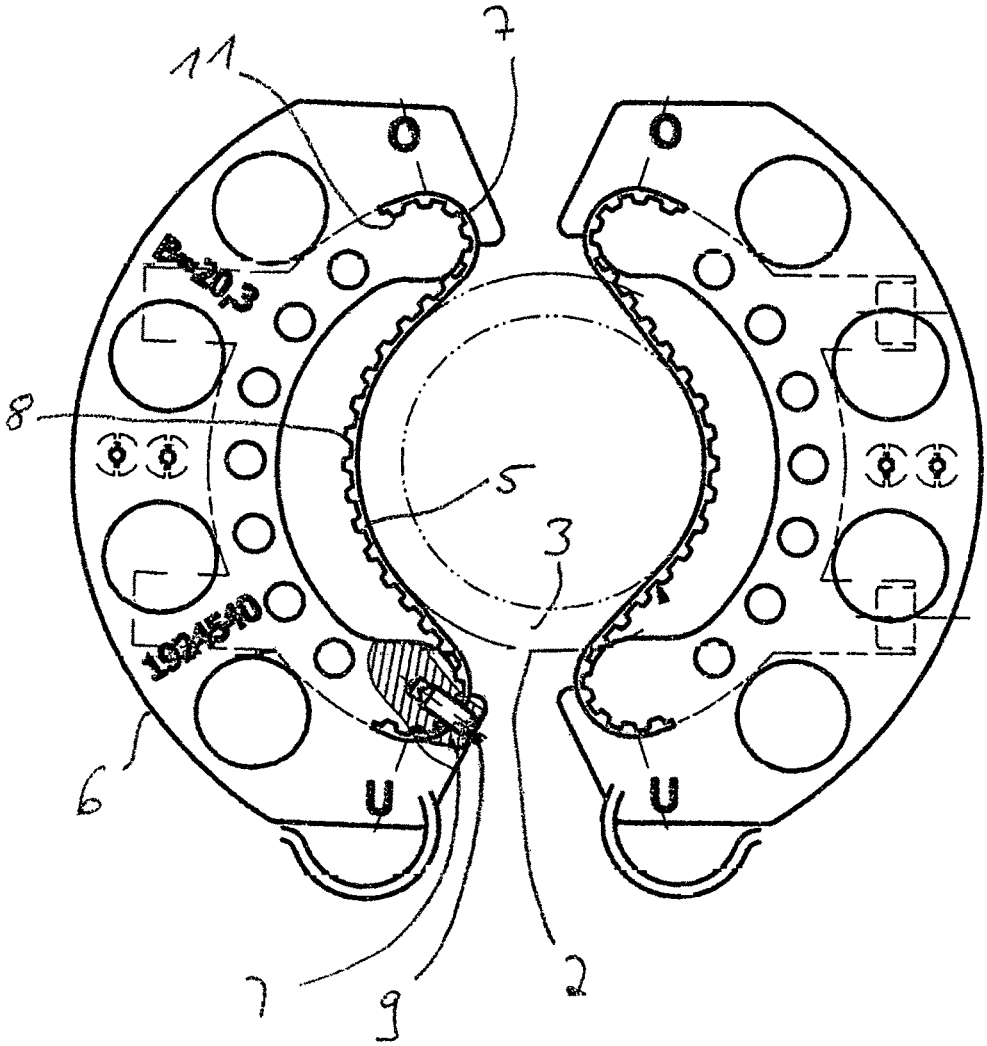
FIG. 3: schematically shows a second embodiment of the support elements of the pressing device.

The embodiment according to FIG. 3 is very similar to the embodiment of FIG. 2, the tooth-like ribs 8 being arranged on the side of the toothed belt 5 that faces away from the work piece section 3.

The specification incorporates by reference the disclosure PCT/EP2015/061148, filed May 20,2015 and DE 20 2014 102 403.4, filed May 22, 2014.

The present invention is, of course, in no way restricted to the specific disclosure of the specification and drawing, but also encompasses any modification within the scope of the appended claims.

LIST OF REFERENCE SYMBOLS

1 Pressing device
2 Circumferential surface
3 Work piece section
4 Contact angle
5 Toothed belt
6 Support element
7 Bearing
8 Tooth-like ribs
9 Clamping device
10 Arm
11 Recess

The invention claimed is:

1. A pressing device (1) for pressing finishing tape against circumferential surfaces (2) of substantially cylindrical work piece sections (3) in a finishing process, the pressing device (1) comprising:

at least one elastically bendable pressing element (5) that is substantially inelastic in a longitudinal direction;

a support element (6) having two bearings (7) arranged at a distance from each other, wherein the at least on elastically bendable pressing element (5) is fastened to the two bearings, wherein the two bearings are arranged at a distance from each other in such a manner that finishing tape is pressed against a circumferential surface (2) by the pressing element (5) across a contact angle (4) using a pressing force, wherein the pressing device (1) is adjustable in order to process work piece sections (3) of different diameters, wherein the pressing element is a toothed belt (5) having tooth-like ribs (8), and wherein said toothed belt (5) is interlockingly mounted in the support element (6) using the tooth-like ribs (8), the tooth-like ribs (8) formed in end regions of the toothed belt (5) being used to fasten the toothed belt (5) interlockingly to the support element (6) in corresponding recesses (11) formed in the support element.

2. The pressing device (1) according to claim 1, wherein the tooth-like ribs (8) of the toothed belt (5) are arranged on a side of the toothed belt (5) that faces the work piece sections (3).

3. The pressing device (1) according to claim 1, wherein the tooth-like ribs (8) of the toothed belt (5) are arranged on a side of the toothed belt (5) that faces away from the work piece sections (3).

4. The pressing device (1) according to claim 1, wherein the toothed belt (5) comprises a fabric running in the longitudinal direction, and/or steel strips running in the longitudinal direction, around which an elastic plastic is injection-molded, thereby forming the tooth-like ribs (8).

5. The pressing device (1) according to claim 1, further comprising a clamping device (9) configured to fasten the toothed belt (5) to the support element (6).

6. The pressing device (1) according to claim 1, wherein the toothed belt (5) consists of polyurethane, at least on a surface thereof.

7. The pressing device (1) according to claim 1, wherein the tooth-like ribs (8) are introduced only in a portion of the recesses (11) in order to change the length of a section of the toothed belt (5) between the bearings (7).

8. The pressing device (1) according to claim 1, wherein the tooth-like ribs (8) are aligned transversely to the longitudinal direction of the toothed belt (5).

9. The pressing device (1) according to claim 1, wherein the tooth-like ribs (8) are arranged over an entire extent of the toothed belt (5).

10. The pressing device (1) according to claim 1, wherein a position of the toothed belt (5) on the support element (6) is predefined exactly by the recesses (11) in the support element.

11. The pressing device (1) according to claim 1, wherein the toothed belt (5) is fastened to the support element (6) in the longitudinal direction of the toothed belt (5) solely by the interlocking of the toothed belt (5) with the support element (6).

* * * * *